US005107816A

United States Patent [19]

Katogi et al.

[11] Patent Number: 5,107,816

[45] Date of Patent: Apr. 28, 1992

[54] AIR-FUEL RATIO CONTROL APPARATUS

[75] Inventors: Kozo Katogi, Hitachi; Toshio Ishii, Mito, both of Japan

[73] Assignee: Hitachi, Ltd., Tokyo, Japan

[21] Appl. No.: 670,176

[22] Filed: Mar. 15, 1991

[30] Foreign Application Priority Data

Mar. 23, 1990 [JP] Japan ..... 2-071855

[51] Int. Cl.[5] ..... F02D 41/04

[52] U.S. Cl. ..... 123/435; 123/494; 73/116

[58] Field of Search ..... 123/425, 435, 478, 480, 123/494; 73/35 R, 35 KR, 35 K, 35 M, 35 O, 35 I, 116

[56] References Cited

U.S. PATENT DOCUMENTS

| | | | |
|---|---|---|---|
| 4,621,603 | 11/1986 | Matekunas | 123/435 X |
| 4,785,785 | 11/1988 | Oba et al. | 123/494 X |
| 4,846,130 | 7/1989 | Jensen | 123/435 |
| 4,905,654 | 3/1990 | Katsuno et al. | 123/494 |
| 4,942,860 | 7/1990 | Chujo et al. | 123/494 X |
| 4,962,739 | 10/1990 | Wataya | 123/435 |
| 4,996,960 | 3/1991 | Nishiyama et al. | 123/435 |

FOREIGN PATENT DOCUMENTS

| | | | |
|---|---|---|---|
| 0221433 | 12/1984 | Japan | 123/435 |
| 0126337 | 6/1986 | Japan . | |
| 0075326 | 4/1988 | Japan | 123/435 |
| 0096440 | 4/1989 | Japan . | |

*Primary Examiner*—Willis R. Wolfe

*Attorney, Agent, or Firm*—Antonelli, Terry Stout & Kraus

[57] ABSTRACT

There is provided an air-flow ratio control apparatus for an internal combustion engine, which comprises a means for measuring a flow amount of intake air, a means for assuming an amount of intake air filled in a surge tank, and means for assuming an amount of exhaust gas remaining in a combustion chamber, and controls a feed amount of fuel based on the result of an assumption effected by these means. Therefore, according to the present invention, an amount of intake air supplied into each cylinder can be precisely measured, an air-flow ratio can be kept constant even in a transient state such as in acceleration or deceleration, and NOx, CO and HC contained in exhaust gas can be reduced. Further, with this arrangement, the size of a conventional ternary catalyst can be reduced.

17 Claims, 4 Drawing Sheets

AIR-FUEL RATIO CONTROL APPARATUS

BACKGROUND OF THE INVENTION

The present invention relates to an air-fuel ratio control apparatus for a gasoline engine by which smooth acceleration can be carried out while keeping an air-fuel ratio constant even when acceleration is abruptly carried out, and more specifically, to an air-fuel ratio control apparatus suitable for an automobile gasoline engine having a fuel injection system.

DESCRIPTION OF PRIOR ART

In a conventional air-fuel ratio control apparatus, an amount of intake air is measured in an intake air path before the air enters a surge tank and an amount of fuel corresponding to the amount of the intake air is injected and combusted in a combustion chamber.

In this case, although an amount of air passing through an air flow meter coincides with an amount of air passing through a suction valve in a normal operation, an amount of air passing through the air flow meter differs from an amount of air passing through the suction valve by an amount of air which is increased or decreased in the surge tank when acceleration or deceleration is carried out, and thus an air-fuel ratio would be greatly deteriorated if not corrected.

A conventional correction method increases an amount of fuel by correcting an amount of intake air by an acceleration correction to make an air-fuel ratio rich when acceleration is carried out and reduces an amount of fuel by correcting an amount of intake air by a deceleration correction to make an air-fuel ratio lean when deceleration is carried out.

Nevertheless, this conventional method is defective in the determination of data, and thus there are methods proposed to improve the conventional one by which a correction is carried out based on a past history of an amount of air supplied into a surge tank and an amount of fuel injection, which are disclosed in, for example, Japanese Patent Unexamined Publication Nos. 61-126337 and 1-96440. These methods determine a pressure in the surge tank and calculate an amount of air passing through a suction valve based on the pressure.

Nevertheless, since the amount of air passing through the suction valve depends on a difference between a pressure in the surge tank and a pressure in a combustion chamber in a suction stroke, a problem arises in that a pressure in the combustion chamber affected by a change in a combustion state when acceleration or deceleration is carried out must be considered.

The above conventional technology does not consider the combustion state in the combustion chamber of an engine, and thus a problem arises in that even if an amount of intake air is precisely measured and an amount of fuel corresponding to the amount of the intake air is injected, the amount of intake air is reduced by an amount of exhaust gas remaining in the combustion chamber and an air-fuel ratio is changed, because a remaining amount of combustion gas is changed as a pressure in the combustion chamber increases when acceleration is abruptly carried out.

SUMMARY OF THE INVENTION

An object of the present invention is to realize an optimum air-fuel ratio in a combustion chamber by assuming a remaining amount of combustion gas, also considering a load imposed on an engine.

To achieve the above object, the present invention provides:

a means for measuring an amount of intake air to measure the operating conditions of an engine;

a means for assuming an amount of air filled in a surge tank; and a means for assuming an amount of exhaust gas remaining in the combustion chamber and determining a history of an amount of fuel injection.

An amount of intake air obtained from the intake air measuring means equals an amount of air flowing to the surge tank, and thus these amounts equal an amount air passing through a suction valve when the discussion is limited only to a normal operation.

In acceleration, the surge tank changes from a closed state to an open state and the above amount of the intake air is used only to be filled in the surge tank and not be sucked by the combustion chamber. Thus, in acceleration, an amount of intake air is calculated by the means for assuming an amount of air filled in the surge tank. Further, according to the present invention, the above amount of intake air is corrected by the means for assuming an amount of exhaust gas remaining in the combustion chamber.

Further, the means for determining a history of an amount of fuel injection enables an air-fuel ratio to be kept within a predetermined range even if fuel is differently atomized by a temperature in an intake manifold or a combustion state is changed by a remaining amount of combustion gas.

DESCRIPTION OF THE PREFERRED EMBODIMENTS

An air-fuel ratio control apparatus according to the present invention will be described with reference to illustrated embodiments.

Figure 1:
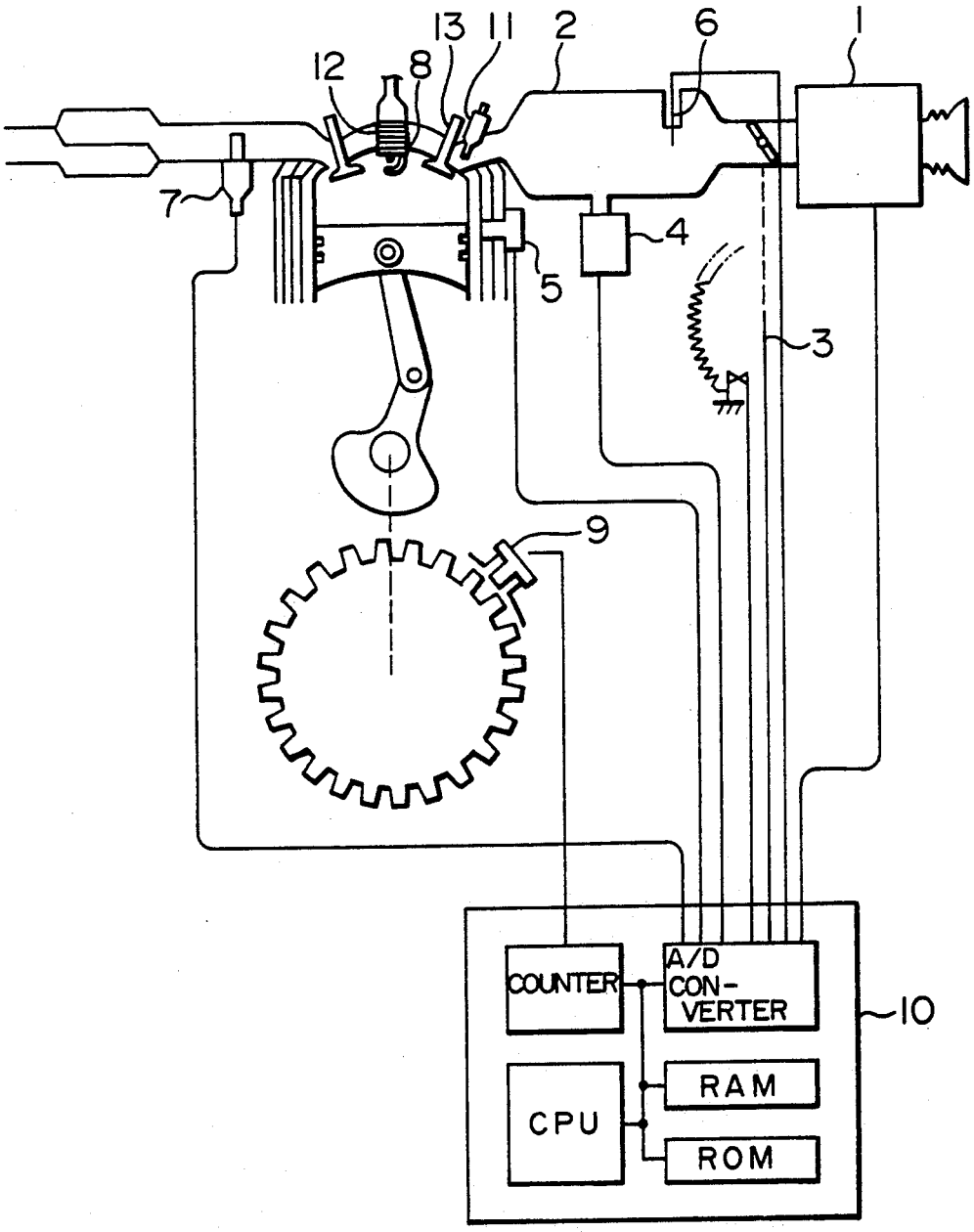
FIG. 1 is a diagram showing the arrangement of an engine control system to which an embodiment of an air-fuel ratio control apparatus according to the present invention is applied.

FIG. 1 shows an engine control system to which the air-fuel ratio control apparatus according to the present invention is applied, wherein a hot wire air flow meter 1 as a means for measuring an amount of intake air, a throttle sensor 3 and a pressure sensor 4 as means for assuming an amount of air filled in a surge tank 2, and sensors such as a hot water sensor 5, an intake air temperature sensor 6, an air-fuel ratio sensor 7 for measuring an air-fuel ratio of exhaust gas, a washer type cylinder internal pressure sensor 8, an RPM sensor 9 and the like are connected to an engine controller 10, so that an injector 11, an ignition plug 12 and the like are driven to provide a control output for rotating the engine.

To drive the engine while an optimum air-fuel ratio is kept, an amount of fuel corresponding to an amount of intake air supplied into the engine must be injected, and an amount of the intake air is preferably determined by measuring an amount of air passing through a suction valve. From a view point of cost and mounting, however, the surge tank 2 is interposed between the hot wire air flow meter 1 and the suction valve 13 and the single hot wire air flow meter 1 measures an amount of intake air supplied into each cylinder. As a result, the surge tank 2 serves as a buffer for the intake air supplied into each cylinder, so that an air pulsation in the hot wire air flow meter 1 is prevented, but a time lag is caused between an amount of air passing through the hot wire air flow meter 1 and an amount of air supplied into each cylinder through the suction valve 13 accordingly.

An amount of air passing through the throttle valve is in proportion to a difference between an atmospheric pressure and a pressure in the surge tank 2, and when the throttle valve is fully opened, a negative pressure in the surge tank 2 is minimized.

Figure 2:
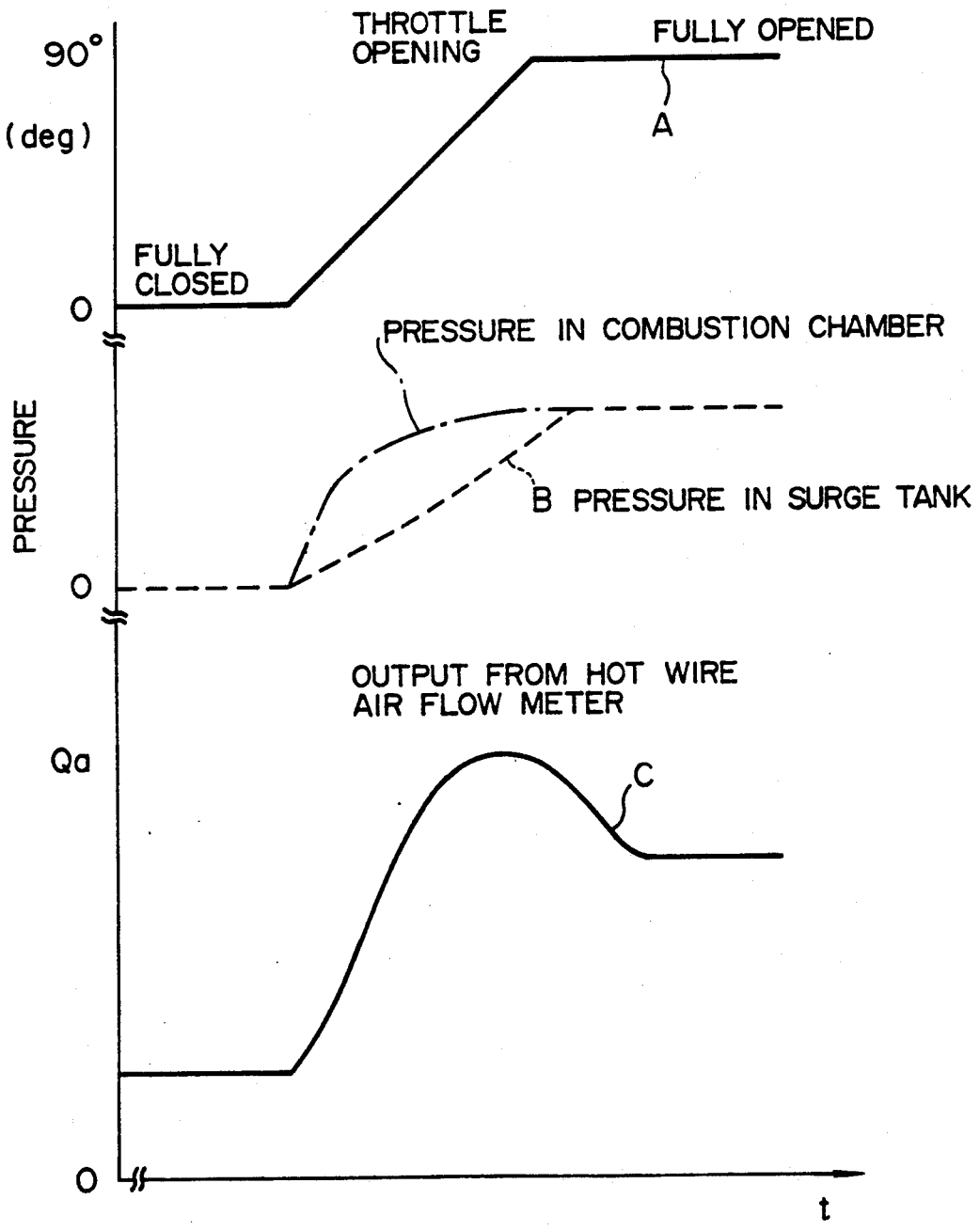
FIG. 2 is a characteristics diagram for explaining an operation.

When the throttle valve is opened from a fully closed state, as shown by a solid line A in FIG. 2, a signal from the hot wire air flow meter 1 is overshot by the capacity of the surge tank 2, as shown by a solid line C in FIG. 2, whereas a pressure in the surge tank 2 is flatly increased, as shown by a dotted line B in the same way.

Although an amount of air passing through the suction valve 13 is in proportion to a difference between a pressure in the surge tank 2 and a pressure in a combustion chamber when the suction valve 13 is opened, the pressure in the combustion chamber is different depending on whether or not combusted gas remains.

In particular, an amount of the remaining combusted gas is greatly different whether the throttle valve is fully closed or slightly opened, and when the throttle valve is fully closed, only a small amount of combusted gas remains because fuel gas itself is very lean.

From the behavior of the amount of air shown in FIG. 2, an amount of fuel injection Ti is determined by the following equation.

$$Ti=[Qa-Q(Pm_n-Pm_{n-1})-R(Pm_{ref})]\times K/N$$

where,

Qa: an amount of intake air measured by the hot wire air flow meter 1;

$Pm_n$, $Pm_{n-1}$: an amount of air needed to fill the surge tank 2, respectively, every stroke;

$R(Pm_{ref})$: indicating an amount of combusted gas remaining in a cylinder in a combustion stroke, and $Pm_{ref}$ represents a pressure in the surge tank 2 when the combusted gas remains in a suction stroke;

K: a constant determined by the characteristics of an injector; and

N: an RPM of the engine

At this time, although the pressure in the surge tank 2 can be directly measured by using the pressure sensor 4, it can also be assumed from an RPM of the engine N and an opening of the throttle.

Further, $Q(Pm_n-Pm_{n-1})$ may be calculated every predetermined time rather than every combustion stroke.

Figure 3:
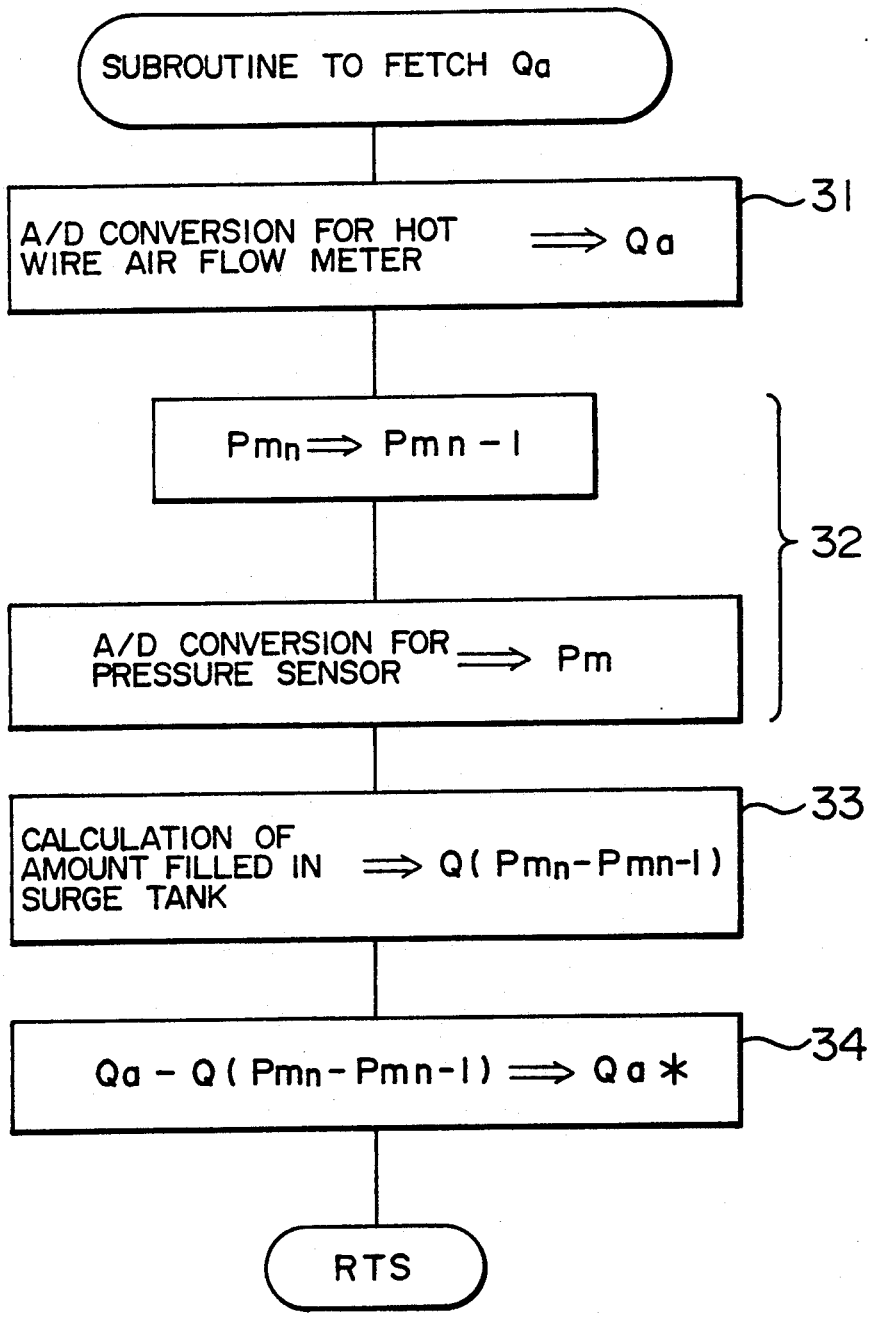
FIG. 3 is a flowchart explaining a basic process in an embodiment according to the present invention.
Figure 4:
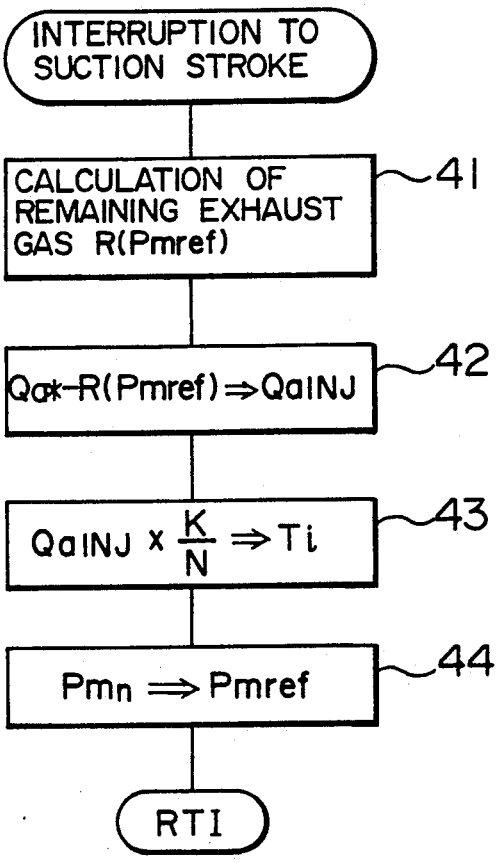
FIG. 4 is a flowchart explaining an interruption process in the same manner.

FIGS. 3 and 4 are flow charts showing processes for the engine controller 10 of this embodiment to calculate a fuel injection time Ti. To explain with reference to these flowcharts, first, the engine controller 10 fetches a signal from the hot wire air flow meter 1 through an A/D converter at every predetermined time or every suction stroke of each cylinder to determine an amount of intake air Qa (31).

Next, the engine controller 10 fetches a signal from the pressure sensor 4 through the A/D converter to determine a pressure $Pm_n$ in the surge tank 2, and further stores a previous pressure $Pm_n$ as $Pm_{n-1}$ (32).

The engine controller 10 determines an amount of air $Q(Pm_n-Pm_{n-1})$ filled in the surge tank 2 from a difference between the present pressure $Pm_n$ and the previous pressure $Pm_{n-1}$ (33).

Further, the engine controller 10 determines a value obtained by subtracting $Q(Pm_n-Pm_{n-1})$ from the amount of intake air Qa as a basic amount of intake air Qa*(34).

On the other hand, a CPU is interrupted every suction stroke of such cylinder so that the CPU effects the process of FIG. 4.

First, the CPU assumes an amount of remaining gas $R(Pm_{ref})$ in accordance with $Pm_{ref}$ corresponding to a cylinder by which the interruption was caused at that time (41).

Next, the CPU determines a value obtained by subtracting $R(Pm_{ref})$ from the basic amount of intake air (42) and determines the amount of fuel injection Ti by multiplying the value by the coefficient K and dividing the same by the RPM of the engine N (43).

Further, the CPU stores the pressure $P_{mn}$ in the surge tank at this time as $Pm_{n-1}$ and this stored value is used for the interruption at the next suction stroke (44).

Note, the calculation of the amount of fuel injection Ti may be corrected in accordance with an opening of the throttle and a water temperature or an intake air temperature, as shown in the conventional example, by which a more improved control can be carried out.

Further, an arrangement in which the pressure sensor 4 is not used is possible, wherein a pressure in the surge tank 2 may be assumed from a difference between an amount of air passing through the suction valve and an amount of intake air Qa which are proportion to an RPM of the engine, or it may be also possible that an amount of intake air supplied into the engine is determined from an assumed pressure conversely and the pressure is assumed again from a difference between the amount of intake air and a signal from the hot wire air flow meter.

Next, another embodiment of the present invention will be described.

An amount of combusted gas remaining in the combustion chamber of the engine can be assumed by a method of using an output from the cylinder internal pressure sensor provided in the combustion chamber.

Figure 5:
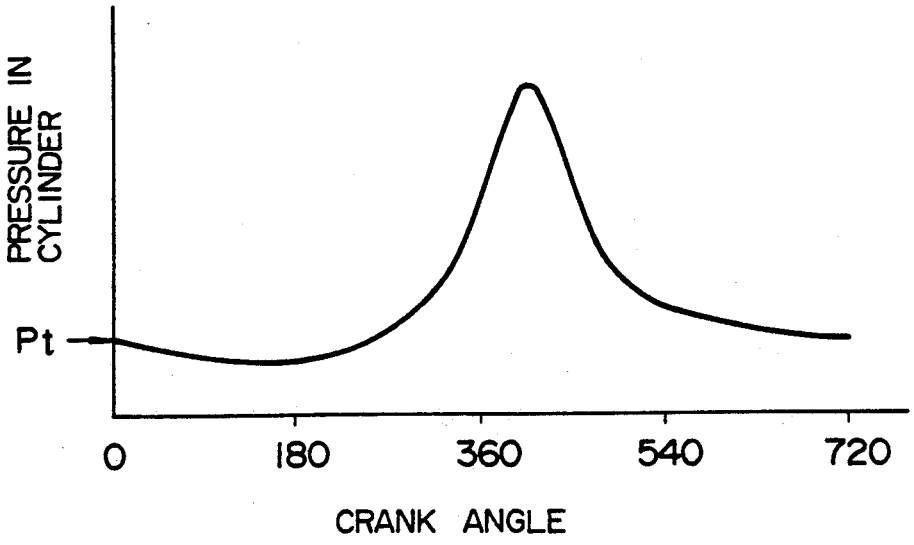
FIG. 5 is a characteristics diagram explaining a cylinder internal pressure.

More specifically, as shown in FIG. 1, the washed type cylinder internal pressure sensor 8 is used and a pressure in the combustion chamber is determined in response to a signal therefrom. Then, as shown in FIG. 5, a pressure Ptn at the upper dead point at which a suction stroke begins is determined and an amount of air passing through the suction valve 13 is determined from a difference between a pressure $P_{mn}$ in the surge tank 2 and the pressure Ptn.

Further, in FIG. 2, when the throttle valve begins to open from a fully closed state, a load begins to be imposed on the engine, so that a pressure in the combustion chamber increases. Therefore, an amount of air entering the combustion chamber when the throttle valve is fully closed differs from that when the throttle valve is slightly opened. To discriminate between the fully closed state and the slightly opened state, a signal value of the throttle sensor 3 which has been fully closed may be used or a not shown idle switch may be provided to use an ON/OFF signal therefrom.

More specifically, an increase in an amount of remaining exhaust gas is detected to correct $R(Pm_{ref})$ when the signal value of the throttle sensor 3 changes from the totally closed state toward a direction in which the throttle sensor 3 opens or when the ON/OFF signal of the idle switch changes.

Therefore, according to this embodiment, the basic amount of intake air can be more precisely measured and a more precise air-flow ratio can be easily obtained.

According to the present invention, an amount of intake air supplied into each cylinder can be precisely measured, an air-flow ratio can be kept constant even in a transient state such as in acceleration or deceleration, and NOx, CO and HC contained in exhaust gas can be reduced. Further, with this arrangement, the size of a conventional ternary catalyst can be reduced.

What is claimed is:

1. An air-fuel ratio control apparatus for an internal combustion engine, comprising a means for detecting an amount of gas remaining in a combustion chamber at the suction stroke of each cylinder, wherein said means for detecting an amount of gas remaining in said combustion chamber at the suction stroke of said each cylinder detects the amount of gas remaining in said combustion chamber at the suction stroke of each cylinder based on a difference between a pressure in said combustion chamber of said cylinder and a pressure in the intake manifold of said cylinder.

2. An air-flow ratio control apparatus according to claim 1, wherein said means for detecting an amount of gas remaining in said combustion chamber uses an output from a cylinder internal pressure sensor provided in said combustion chamber.

3. An air-flow ratio control apparatus for an internal combustion engine having a surge tank interposed between the intake air manifold of an engine and an intake air flow meter and using a result of a measurement of a flow amount of intake air as one of parameters for controlling a feed amount of fuel, comprising a means for detecting an amount of intake air filled in said surge tank and a means for detecting an amount of gas remaining in a combustion chamber at the suction stroke of each cylinder, wherein the result of a detection effected by said means of said filled amount of intake air and aid amount of gas remaining in said combustion chamber is contained as said parameter for controlling said feed amount of fuel.

4. An air-flow ratio control apparatus according to claim 3, wherein an acceleration correction control is carried out by detecting that a throttle valve is apart from a fully closed state.

5. An air-flow ratio control apparatus according to claim 3, wherein said means for detecting an amount of gas remaining in said combustion chamber uses an output from an cylinder internal pressure sensor provided in said combustion chamber.

6. An air-flow ratio control apparatus according to claim 3, wherein said means for detecting an amount of intake air filled in said surge tank detects the amount of intake air filled in said surge tank based on a pressure in said surge tank and an opening of a throttle valve, and said means for detecting an amount of gas remaining in said combustion chamber at the suction stroke of said each cylinder detects the amount of gas remaining in said combustion chamber at the suction stroke of said cylinder based on a pressure in said surge tank at the previous suction stroke of said cylinder.

7. An air-flow ratio control apparatus according to claim 6, wherein said pressure in said surge tank is assumed from a difference between an amount of air passing through a suction valve and a flow amount of intake air.

8. An air-flow ratio control apparatus according to claim 7, wherein a flow amount of intake air in an engine is determined from said assumed pressure in said surge tank and a pressure in said surge tank is assumed again from a difference between said flow amount of intake air in the engine and a signal from an intake air flow meter.

9. An air-flow ratio control apparatus according to claim 3, wherein said means for detecting amount of intake air filled in said surge tank detects the amount of intake air filled in said surge tank based on a pressure in said surge tank and an opening of a throttle, valve, and said means for detecting an amount of gas remaining in said combustion chamber at the suction stroke of said each cylinder detects the amount of gas remaining in said combustion chamber at the suction stroke of said each cylinder based on a difference between a pressure in the combustion chamber of said cylinder and a pressure in the intake manifold of said cylinder.

10. An air-flow ratio control apparatus according to claim 9, wherein said pressure in said surge tank is assumed from a difference between an amount of air passing through a suction valve and a flow amount of intake air.

11. An air-flow ratio control apparatus according to claim 10, wherein a flow amount of intake air in an engine is determined from said assumed pressure in said surge tank and a pressure in said surge tank is assumed again from a difference between said flow amount of intake air in the engine and a signal from an intake air flow meter.

12. An air-flow ratio control apparatus according to claim 3, wherein said means for detecting an amount of intake air filled in said surge tank detects the amount of intake air filled in said surge tank based on a pressure in said surge tank and an intake air temperature, and said means for detecting an amount of gas remaining in said combustion chamber at the suction stroke of said each cylinder detects the amount of gas remaining in said combustion chamber at the suction stroke of said each cylinder based on a pressure in said surge tank at the previous suction stroke of said cylinder.

13. An air-flow ratio control apparatus according to claim 12, wherein said pressure in said surge tank is assumed from a difference between an amount of air passing through a suction valve and a flow amount of intake air.

14. An air-flow ratio control apparatus according to claim 13, wherein a flow amount of intake air in an engine is determined from said assumed pressure in said surge tank and a pressure in said surge tank is assumed again from a difference between said flow amount of intake air in the engine and a signal from an intake air flow meter.

15. An air-flow ratio control apparatus according to claim 3, wherein said means for detecting an amount of intake air filled in said surge tank detects the amount of intake air filled in said surge tank based on a pressure in said surge tank and an intake air temperature, and said means for detecting an amount of gas remaining in said combustion chamber at the suction stroke of said each cylinder detects the amount of gas remaining in said combustion chamber at the suction stroke of said each cylinder based on a difference between a pressure in the combustion chamber of said cylinder and a pressure in the intake manifold of said cylinder.

16. An air-flow ratio control apparatus according to claim 15, wherein said pressure in said surge tank is assumed from a difference between an amount of air passing through a suction valve and a flow amount of intake air.

17. An air-flow ratio control apparatus according to claim 16, wherein a flow amount of intake air in an engine is determined from said assumed pressure in said surge tank and a pressure in said surge tank is assumed again from a difference between said flow amount of intake air in the engine and a signal from an intake air flow meter.

* * * * *